US005273506A

United States Patent [19]

Dawson, Jr.

[11] Patent Number: 5,273,506

[45] Date of Patent: Dec. 28, 1993

[54] SELF SPOTTING EXERCISE APPARATUS

[76] Inventor: Fredric O. Dawson, Jr., 1588 McKendrie St., San Jose, Calif. 95126

[21] Appl. No.: 898,580

[22] Filed: Jun. 15, 1992

[51] Int. Cl.[5] ..... A63B 21/06

[52] U.S. Cl. ..... 482/104; 482/98

[58] Field of Search ..... 482/94–104

[56] References Cited

U.S. PATENT DOCUMENTS

| | | | |
|---|---|---|---|
| 3,235,255 | 2/1966 | Leflar | 482/104 |
| 4,564,194 | 1/1986 | Dawson | 482/104 X |
| 4,625,959 | 12/1986 | Schleffendorf | 482/100 |
| 4,729,561 | 3/1988 | Desjardins | 482/104 |
| 4,750,739 | 6/1988 | Lange | 482/104 |
| 4,781,374 | 11/1988 | Lederman | 482/104 X |
| 4,974,838 | 12/1990 | Sollenberger | 482/101 |
| 4,998,723 | 3/1991 | Santoro | 482/104 |
| 5,011,141 | 4/1991 | Towley, III et al. | 482/104 |
| 5,050,868 | 9/1991 | Pearson | 482/104 X |
| 5,141,480 | 8/1992 | Lennox et al. | 482/104 |

FOREIGN PATENT DOCUMENTS

| | | | |
|---|---|---|---|
| 456790 | 3/1928 | Fed. Rep. of Germany | 482/104 |
| 3744449 | 7/1989 | Fed. Rep. of Germany | 482/104 |
| 1447999 | 6/1966 | France | 482/104 |
| 2328486 | 5/1977 | France | 482/104 |

*Primary Examiner*—Robert Bahr

*Attorney, Agent, or Firm*—Robert Samuel Smith

[57] ABSTRACT

A weight lifting station including a pair of guide posts for guiding a barbell assembly in a vertical direction. The barbell assembly includes a weight bar, a sleeve telescoped over the weight bar and stops attached to the sleeve with catch pins to restrain the stops in any one of three conditions of orientation. In one condition, the catch pins lock the stops in engagement with apertures in the posts thereby preventing vertical movement of the bar from a selected vertical position. In another condition, the catch pins lock the stops in a position disengaged and remote from the apertures permitting the barbell assembly to slide vertically on the guide posts. In the third condition, a user may manually rotate the sleeve, throughout a small range limited by the catch pins from a position where the stops are fully engaged with the apertures to a position where the stops are withdrawn from the apertures therby providing the user with a self spotting capability.

6 Claims, 1 Drawing Sheet

SELF SPOTTING EXERCISE APPARATUS

BACKGROUND OF THE INVENTION

1. Field of the Invention

This invention relates generally to exercise equipment and more particularly to a multipurpose self spotting weight lifting apparatus.

2. Prior Art and Information Disclosure Statement

Exercise equipment generally falls into one of two main categories. A first category of exercise equipment is primarily concerned with improving the cardiovascular system by performing rapid repetitious movements to induce deep breathing and rapid pulse rate. Exercise equipment of the second category is more concerned with improving muscle tone and increasing muscle mass. Weight training generally belongs to the second category.

The most common apparatus for weight training are free weights (barbell) and weight lifting stations. Free weights usually include a long steel bar provided with a number of disk shaped weights and collars for positioning the weights on the bar. Free weights are often used with a weightlifting bench.

One common danger of lifting free weights is that a weight lifter might injure himself by losing control and dropping the weights. It is therefore a common safety practice for weight lifters to exercise in pairs so that one lifter can act as a "spotter" for the other lifter. A spotter stands behind the lifter and grabs the barbell if the lifter seems to be losing control of it. This method is often inconvenient since a lifter may not find a partner.

U.S. Pat. No. 4,564,194 to Dawson is an apparatus intended to overcome this problem and is hereby incorporated by reference into this specification. The invention comprises a weight lifting station having a compound bar including a central bar within a sleeve centrally positioned on the central bar. Disk weights are positioned on each end of the bar. Two sliders are attached to the bar, one on each end of the bar, which are slidably mounted on vertically oriented guide posts. Each vertical post has a vertical row of locating holes. The sleeve centrally located on the center bar extends almost to each vertical post. Two "L"shaped stops are attached to the sleeve, one at each end of the sleeve so that when the sleeve is rotated by a turn of the users wrist, each stop is brought into engagment with one of the locating holes in the guide posts. The stops thereby provide a weight lifter with a method of self spotting. An additional pair of independent stop pins are also attachable to the posts for supporting the bar at any lower position for starring the exercise. Therefore, the user can perform his exercise by starting the lift from the lowermost position which is where the independent stop pins are located, then secure the bar at any intermediate height by simply fuming his wrist to rotate the spotter stops into adjacent apertures.

A problem with the Dawson aparatus as disclosed is that since the safety stop pins are completely separable from their respective vertical posts, they can be disengaged from the uprights during the exercise leading to great distress to the user. Another problem with the separable stop pins as disclosed is that one or both of the pins may be lost so that a user may be tempted to use the apparatus without using the independent stop pins. Yet another problem with the independent stop pins as disclosed is that these stop pins must absorb great impact on those occasions when the user collapses under the exhaustive effort of performing an exercise so that the bar comes crashing down on the stop pins. This ultimately leads to distortion of the posts and stops and unreliable attachment of the stops to the posts as well as slicking of the guides on the uprights.

Another problem with the Dawson apparatus is that excessive rotation of the wrists such as when performing bench presses in order to disengage the stops misaligns the forearm with the direction of application of force thereby detracting from the ability of the user to exert his maximum effort.

The Dawson invention further discloses a cable attached at one end to a pulldown bar and extending over an overhead fixture of pulleys and down to a hook which may be detachably engaged with the center of the compound bar. The user pulls down on the pulldown bar thereby lifting the compound bar with weights in order to perform the exercise. The problem with this arrangement is that during the course of the exercise, the stop pins can swivel into engagement with the posts thereby inadvertently locking the compound bar while the user is trying to perform his exercise with the pulldown.

Another problem with the Dawson invention as disclosed is that considerable frictional force is developed between the metal sleeves sliding on the metal upright posts resulting in unpredictablity of the force required to perform the exercise.

THE INVENTION

Objects

It is an object of this invention to provide a self spotting weightlifting apparatus.

It is another object of this invention to provide improvements over self spotting apparatus of the prior art.

It is another object of this invention to provide an adjustable stop that arrests vertical motion of a weight bar at a selected location in a range of locations without requiring uncertain excessive rotation of the wrists as required by devices of the prior art.

It is another object that the adjustable stop be capable of being maintained in a position where it will not accidentally interfere with motion of the weight bar when the bar is attached to an overhead cable and pulley system to perform pulldowns.

It is another object to provide a safety stop slidably attached to the vertical uprights that will cushion the impact of the descending bar thereby avoiding damage to the apparatus. and that the adjustable stop and and safety stop be constructed in a manner that they will not interfere with one another.

It is another object that the adjustable stop be lockable in engagement with the vertical uprights so that the adjustable stops may not be inadvertently disengaged from the uprights.

It is another object to reduce the frictional force of the sleeves sliding on the uprights.

Summary

This invention is directed toward a self spotting exercise apparatus featuring a sleeve rotatably mounted on a weight bar and having two "slider" sleeves attached respectively on the ends of the bar sleeve. Each one slider sleeve is telescoped on one of two upright posts, each post having a column of holes. An L shaped bar forming a locking pin (spotter stop) is attached to each end of the bar sleeve that swings and engages one of the apertures when the bar sleeve is rotated so the user may secure the weight bar in a vertical location by simply rotating the bar sleeve on the bar. A plate having several threaded holes is attached to each sleeve. Pins screwed into the appropriate one of these holes provides that the adjustable stop be arbitrarily secured in any one of three conditions.

In one condition, each spotter stop is secured firmly to its respective upright so that the user can perform, e.g., pullups without concern that the bar will become loose while he it performing his exercise. In the second condition, the spotter stop is secured remote from engagement with the upright thereby ensuring that the user can perform exercises with a pulldown bar attached by a cable to the weight bar without concern that the spotter stops will inadvertently engage with the upright and interrupt the user during his exercise. In the third condition, the sleeve is confined to rotate over a very small range including engagement with the upright thereby occurence of excessive, uncontrolled rotation of the wrist when performing the bench press.

A safety stop is slidably mounted on each upright which may be engaged with any of the holes in the column of holes thereby providing a lower limit to the location of the weight bar sliding on the uprights. A spring is mounted on each safety stop providing cushions that soften the impact of the weight bar contacting the safety stops. The slider sleeves are constructed so as to prevent interference of each spring with its respective adjustable stop.

DRAWINGS

DESCRIPTION OF A PREFERRED MODE

Figure 1:
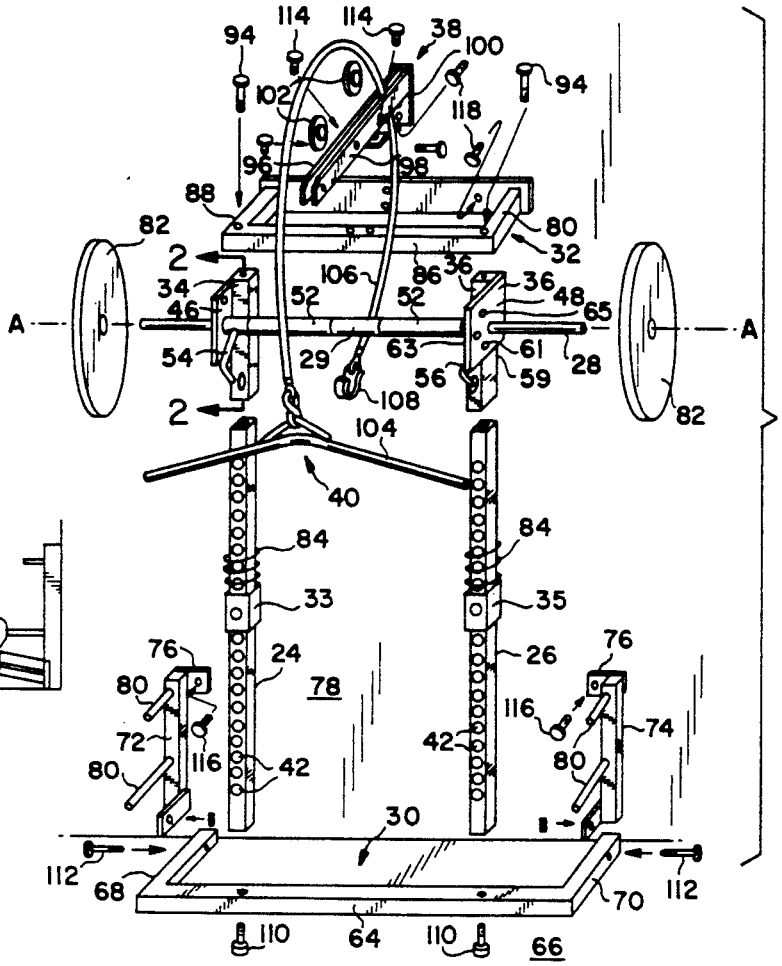
FIG. 1 is a perspective view of the weight lifting station of this invention.

Turning now to a discussion of the drawings, FIG. 1 shows an exercise apparatus in accordance with the present invention including a weight lifting station 20. The weight lifting station 20 includes a pair of vertically oriented guide posts 24 and 26, a horizontally oriented weight bar 28, a base assembly 30, and an upper brace assembly 32. A pair of post sliders 34 and 36 are telescoped over guide posts 24 and 26 respectively. A support beam assembly 38 is attached to brace assembly 32 and pull-bar assembly 40 is engagable with support beam assembly 38 and a sleeve 29 around bar 28.

Figure 2:
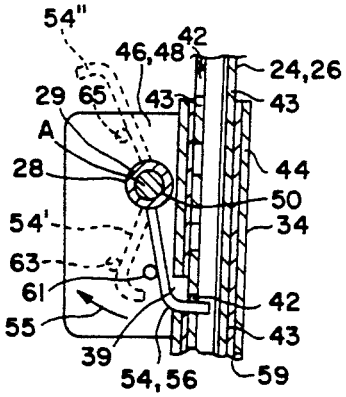
FIG. 2 is a sectional view of the slider construction.

With additional reference to FIG. 2, guide posts 24 and 26 are preferably square tubular members provided with a plurality of vertically spaced apertures 42. It is an embodiment of this invention that the inner surfaces 44 of sliders 34 and 36 are coated with high density polyethylene while the outer surface 43 of the upright posts are coated with epoxy. Both of these polymer surfaces forming a sliding interface will permanently retain silicone lubricant in contrast to metal surfaces. The coefficient of friction of the interface is thereby permanently and dramatically reduced. and provides a smoother sliding action.

Plates 46 and 48 are welded to post sliders 34 and 36 respectively having holes 50 receptive to the weight bar 28 which is welded to each of the plates 46 and 48 and thus, weight bar 28 is horizontally supported for vertical movement along the guide posts 24 and 26.

A bar sleeve 29 is slidably telescoped over bar 28 between plates 46 and 48. The bar sleeve 29, which is free to rotate around bar 28, is provided with knurling at hand hold locations 52. Sleeve 29 is also provided with a pair of slider stops 54 and 56 which are adjacent to the guide posts 24 and 26 respectively. As noted in FIG. 2, slider stops54 and 56 are substantially "L"shaped pins and have one leg attached to sleeve 29 and another leg engagable with apertures 42 of the guide posts 24 and 26. By gripping the sleeve 29 and rotating it partially around the "A" axis, a user can cause stops54 and 56 to engage and disengage from apertures 42. This pivotal motion is illustrated in FIG. 2 where stop 54 can move to a new position 54' along the path indicated by arrow 55.

Figure 3:
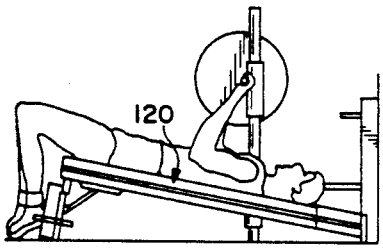
FIG. 3 shows the weight station used to perform bench presses.

The apparatus may be used to perform numerous exercises. The advantages of the apparatus are particularly illustrated with reference to per forming the bench press shown in FIG. 3. The user is shown lying on bench 120 placed between the posts with his hands grasping the weight bar. The exercise is performed by raising the bar in a reciprocating sliding motion of the sliders on the uprights. When the user becomes fatigued, he may simply rotate the sleeve on the bar by turning his wrists thereby engaging the stops in adjacent appertures such as to secure the bar in a vertical location.

FIG. 1 shows safety rests 33 and 35 to be positioned on each upright post. Each rest comprises a short section of sleeve that telescopes onto each upright post providing that the rest may not be removed from the post and possibly be misplaced. Each rest is secured by a pin 37 through a hole in the rest 33 and 35 aligned with a selected one of the apertures in the post 24 and 26 respectively. A spring 84 is telescoped over each guide post 24 and 26 and rests on the top of the safety rest 33 and 35 providing that impact of the post slider 34 or 36 on the rest 33 or 35 is cushioned. FIG. 2 shows post sliders 34 and 36 extending downward on the respective post so that a hole 39 in the slider 34 or 36 can be aligned with an aperture 42 in the post 24 or 26. Therefore the leg of the "L" shaped stop 54 or 56 is inserted through both the hole 39 in the slider AND one of the apertures 42 in th post in order to secure the slider in its vertical position. The spring 84 therefore contacts the lower end 59 of the slider 34 or 36 when the weight bar 28 descends to the rest 33 or 35 thereby presenting a positive cushioning effect and preventing inadvertent engagement of the spring 84 with the leg of the respective stop 54 or 56.

FIG. 2 shows plates 46 and 48 each to have a catch means for maintaining the stops 54 and 56 in a selected one of three orientations indicated in phantom in FIG. 2. The catch comprises catch three holes 61, 63 and 65, for receiving catch pins (not shown in FIG. 2 but shown in FIG. 4, item 130) which selectively confine the orientation of the stop pins 54 and 56. When the catch pin is in the lower hole, the leg of the stop 54 or 56 is secured in the aperture 42 in the post. The weight bar 28 is thereby fixed in a selected vertical location providing that the user can hang from the weight bar 28 to perform exercises such as pullups without concern that the stop 54 or 56 will be accidentally disloged from its aperture 42 resulting in movement of the weight bar.

When the catch pin is in the intermediate hole 63, the leg of the "L"shaped stop 54' (or 56') is confined to rotate between a first location where it just clears the edges of the aligned hole in the slider and aperture in the post and a second location where the leg is in the aligned hole 39 and aperture 42 thereby locking the weight bar 28 in its vertical location. This construction provides greater safety in spotting the weight and also enables the user to exert greater force in performing presses becauses the catch pin confining the orientation of the sleeve 29 in this limited range of positions prevents inadvertent excessive rotation of the wrists by the user in locking and unlocking the bar. When the catch pins are in the top holes 65 of plates 46 and 48 respectively, the stops 54 and 56 are secured remote from the position where they can inadvertently immobolize vertical movement of the bar. In this situation, the weight bar 28 is free to slide vertically as required when the user is performing pulldowns by pulling on pulldown bar 40 secured to one end of cable 106 which passes over an overhead pulley system 32 and has its other end 108 hooked to the sleeve 29 on the weight bar 28.

Referring again to FIG. 1, in one embodiment, a base assembly 30 includes a "C" shaped main base portion 64 which is in contact with a floor surface 66. Attached to the leg portions 68 and 70 of main base 64 are stabilizing assemblies 72 and 74. The stabilizing assemblies are provided with flanges adapted to be attached to a wall surface.78. Stabilizing assemblies 72 and 74 are further provided with weight supporting rods 80 to support a plurality of disk shaped exercise weights such as those shown at 82.

Base assembly 32 includes a "C" shaped main base portion 86 provided with rearwardly extending leg portions 88 and 90. A wall mounting plate is attached to leg portions 88 and 90 and to wall surface 78. the main brace assembly is attached to the top of guide posts 34 and 36 by bolts 94.

Support beam assembly 38 includes a pair of side members 96 and 98, a wall mounting plate 100, and a pair of pulleys 102 attached between side members 96 and 98. Support beam assembly 38 is attached to brace assembly 32 with suitable flanges, nuts and bolts.

Pull bar assembly 40 includes a pull bar 104, an elongated, flexible cable 106, and a hook 108. When cable 106 is trained over pulleys 102, of the support beam asembly 38, and hook 108 is engaged with weight bar 28, pull bar 104 can be used for various pull down exercises referred to above. As discussed above, the "L" shaped spotter stops 54 and 56 may be locked away from interfering with vertical motion of the bar 28 when performing pulldown exercises by rotating the bar sleeve 29 so that the spotter stops 54 and 56 are in their uppermost position 54" and secured by a catch pin in holes 65 of plates 46 and 48 shown in FIG. 2.

To install the weight lifting station of the present invention, the guide posts 24 and 26 are attached to base assembly 30 with fasteners 110 and stabilizing assemblies 72 and 74 are attached to legs 68 and 70 respectively with bolts 112.

The safety rests 33 and 35 and springs 84 are then telescoped over the respective guide posts.

The central sleeve 29 with spotter stops 54 and 56 and attached plates 46 and 48 is slid over the weight bar 28.

The sliders 34 and 36 are then telescoped over guide posts 24 and 26 and 26 with bolts 94. The support beam assemby 38 is attached to brace assembly 32 with nuts and bolts 1 14. Stabilizing assemblies 72 and 74 are then attached to wall surface 78 with screws 116 and upper brace assembly 32 is similarly attached to wall surface 78 with screws 118. Weights 82 can be placed on the ends of the weight bar 28.

In the foregoing paragraphs, an embodiment has been described which meets the objects of the invention. The crux of the invention are improvements in the self spotting weight lifting apparatus including a spotter stop and catch assembly that minimizes excessive rotation of the wrist thereby improving performance of the user, reduces the impact of the weight contacting a spring loaded adjustable safety stop, locks the spotter stop in place to prevent dislodging of the spotter stop when performing exercises such as pullups, securing the spotter stop in a position remote from the locking position thereby improving reliability of the apparatus in performing exercises such as pulldowns.

Figure 4:
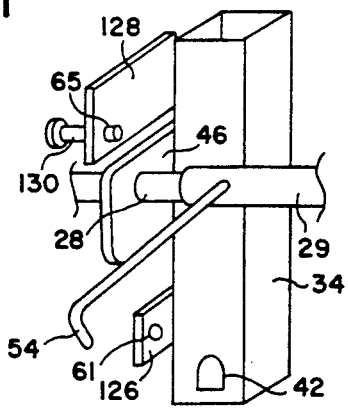
FIG. 4 shows a second embodiment of the slider and stop.

Other embodiments are within the scope of the invention such as a construction in which the apparatus stands alone unsupported by a wall. FIG. 4 shows an embodiment of the sleeve-spotter pin construction including a slider 34 and spotter pin 54 hangably attached to the slider 34 by plate 46. Plate 46 also supports one end of weight bar 28. Flange 126 with lower hole 61 is secured to the lower end of slider 34. Flange 128 is upper catch hole 65 is secured to the upper end of slider 34. Catch pin 130 is shown in upper hole 65. Intermediate hole (63 in FIG. 2) is omitted in the embodiment of FIG. 4.

The foregoing descriptions of these improvements have been presented to illustrate the invention and are not intended to define the scope of the invention. I therefore wish to define the scope of the invention by the appended claims.

I claim:

1. A weight lifting station comprising:

a pair of separated, substantially vertical guide posts, each provided with a plurality of vertically spaced apertures;

a pair of sliders, one slider telescoping on one of said posts and said other slider telescoping on said other post;

a pair of plate means, one said plate means secured to one said slider and said other plate means secured to said other slider;

a bar means secured to said plate means in operable combination with said sliders and plate means to provide that said bar means be oriented substantially horizontally, adapted to receive one or more exercise weights and can reciprocate on said vertical posts;

a sleeve means rotatably telescoped on said bar means;

a pair of spotter stop means, one stop means secured to one end of said sleeve means adjacent to one said post and said other stop means secured to another end of said sleeve means adjacent to said other post, each stop means in operable arrangement with said respective post to engage a selected one of said apertures when said sleeve means is oriented in a first position, disengaged from said aperture when said sleeve is oriented in a second position, remote from said aperture when said sleeve means is oriented to a third position;

a first catch means mounted on at least one of said plates for selectively securing said stop means in said first position;

a third catch means mounted on at least one of said plates for selectively securing said sleeve in said third position.

2. A weight lifting station as in claim 1 which comprises:

a second catch means mounted on at least one of said plate means for selectively maintaining said stop means in a range of positions between said first and second positions.

3. A weight lifting station as in claim 2 wherein said second catch means is a catch pin insertable in a second hole in each one of said at least one plate means positioned between said first and third holes thereby arranged to maintain said spotter stop means in a range of positions between said first and second positions.

4. A weight lifting station as in claim 1 which comprises:

at least one safety rest means slidably mounted on at least one of said posts including means for engaging said at least one rest means in a selected one of said apertures;

a spring means slidably mounted on said at least one post above and in contact with said safety rest means;

each said slider having a lower end and a hole which can be aligned with a selected one of said apertures such that said respective spotter stop means can engage said aligned hole and selected aperture when required to maintain said bar means in a selected position and said lower end of said slider can slide into contact with said spring means when required.

5. A weight lifting station as in claim 2 wherein:

said first catch means is a catch pin insertable in a first hole in each one of said at least one plate means arranged to maintain said spotter stop means in said first position;

said third catch means is a catch pin insertable in a third hole in each one of said at least one plate means arranged to maintain said spotter stop means in said third position.

6. A weight lifting station as in claim 1 wherein each said post has a surface coated with epoxy and said at least one post slider has an interior surface coated with high density polyethylene thereby providing a sliding interface capable of retaining lubricant with a low coefficient of friction.

* * * * *